US009756904B2

(12) United States Patent
Orand

(10) Patent No.: US 9,756,904 B2
(45) Date of Patent: Sep. 12, 2017

(54) TRACK-AND-FIELD ATHLETIC SHOES WITH AUTO BANKABLE SPIKES

(71) Applicant: Nike, Inc., Beaverton, OR (US)

(72) Inventor: Austin Orand, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 14/618,971

(22) Filed: Feb. 10, 2015

(65) Prior Publication Data

US 2016/0227884 A1 Aug. 11, 2016

(51) Int. Cl.
*A43C 15/02* (2006.01)
*A43B 5/06* (2006.01)

(52) U.S. Cl.
CPC ..... *A43C 15/02* (2013.01); *A43B 5/06* (2013.01)

(58) Field of Classification Search
CPC ..... A43C 15/02; A43C 15/14; A43C 15/09; A43B 5/06; A43B 13/22; A43B 13/24; A43B 13/26; A43B 13/28
USPC ..... 36/134, 62, 64, 65, 66, 116, 129, 132, 36/114, 115, 59 R, 61
See application file for complete search history.

(56) References Cited

U.S. PATENT DOCUMENTS 1,395,234 A * 10/1921 Selinger-Balzer ..... A43C 15/09 36/114
3,631,614 A 1/1972 Rice
6,016,613 A 1/2000 Campbell et al.
6,481,122 B2 11/2002 Brahler
7,194,826 B2 3/2007 Ungari
7,386,948 B2 6/2008 Sink
8,079,160 B2 12/2011 Baucom et al.
8,127,470 B2 3/2012 Connor
8,220,185 B2 7/2012 Baker et al.
8,256,145 B2 9/2012 Baucom et al.
8,453,349 B2 6/2013 Auger et al.
8,453,354 B2 6/2013 Baker
8,656,610 B2 2/2014 Baucom et al.
8,656,611 B2 2/2014 Baucom et al.
8,819,965 B2 9/2014 Baker et al.
2005/0172518 A1* 8/2005 Ungari ..... A43B 5/02 36/134
2009/0151199 A1 6/2009 Connor
2010/0083535 A1 4/2010 Meschter et al.
2010/0186261 A1 7/2010 Baker et al.
2013/0239437 A1 9/2013 Baker
2013/0247418 A1 9/2013 Nurse

FOREIGN PATENT DOCUMENTS

WO WO 2013169052 A1 * 11/2013 ..... A43C 15/02

OTHER PUBLICATIONS

Translation of Park, Young Keun, The Functional Shoe that Automatically Prevents Slipping, WO 2013/169052 A1, translated via google translate on Feb. 24, 2016.*

* cited by examiner

*Primary Examiner* — Clinton T Ostrup
*Assistant Examiner* — Heather Mangine
(74) *Attorney, Agent, or Firm* — Wissing Miller LLP

(57) ABSTRACT

Track-and-field athletic shoes and sole structures for such track shoes are provided. The sole structures may include one or more spike assemblies with movable spikes that enhance the grip of the track shoe over an entire course, including when banking on a turn, and that positions a runners foot in a more natural position relative to the runner's center or mass while banking.

32 Claims, 9 Drawing Sheets

TRACK-AND-FIELD ATHLETIC SHOES WITH AUTO BANKABLE SPIKES

BACKGROUND

Field

The present disclosure relates generally to track-and-field athletic shoes, and more particularly to a sole structure for track-and-field athletic shoes having movable spikes to increase traction when banking.

Description of the Related Art

Generally, track-and-field athletic shoes ("track shoes") used for track events are fitted with spikes on the forefoot portion of the sole to provide traction for accelerating and stopping, and to resist twisting of the shoe when running. Track shoe spikes are provided in various shapes and arrangements depending on the running surface and the particular track-and-field event taking place. Track shoes are typically fitted with a large number of spikes arrayed on the entire forefoot portion of the sole. Some track shoes attach as many spikes as possible, within permitted limits, with the belief that such an arrangement provides greater overall traction. However, when the margin for winning an event may come down to hundredths of a second, minimizing the weight of track shoes is another primary importance, such that runners are forced to balance the weight added to the track shoe by a large number of spikes and the desire for additional traction along the entire course of the track-and-field event. Runners looking to reduce time tend to sacrifice traction in order to reduce the weight of the track shoe. Reduced traction is most notable when banking on a turn, where a runner's body weight shifts to compensate for the bank and all of the spikes may no longer engage the running surface. Thus, a need exists for an improved spike for track shoes that provides improved traction and stability over the entire course of the track-and-field event, including while banking on a turn, and that positions a runners foot in a more natural position relative to the runners center or mass while banking.

BRIEF SUMMARY

The present disclosure discloses track-and-field athletic shoes and sole structures for such track shoes. In the embodiments of the present disclosure, the sole structures may include one or more spike assemblies with movable spikes that enhance the grip of the track shoe over an entire course, including when banking on a turn, and that positions a runners foot in a more natural position relative to the runners center or mass while banking.

One exemplary embodiment of a track shoe according to the present disclosure includes an upper and a sole secured to the upper is provided. The sole has at least one track spike assembly positioned at a forefront region of the sole. Preferably, the track shoe according to this embodiment has a plurality of track spike assemblies, and each track spike assembly has a plurality of spikes movable between a flat position and banking position. Preferably, each track spike assembly includes a spike support member having a channel, and a spike plate positioned at least partially within the channel. The spike plate is movable between the flat position and the banking position, and includes a spike positioned at each end of the spike plate configured to engage a running surface. The spike plate may also include at least one spike positioned between the spikes at each end of the spike plate.

One exemplary embodiment of a sole for a track shoe according to the present disclosure includes, a plate having a forefront region and a rearward region, and at least one track spike assembly positioned at the forefront region of the plate. Preferably, the at least one track spike assembly includes a plurality of track spike assemblies, and each track spike assembly has a plurality of spikes movable between a flat position and banking position. The at least one track spike assembly includes, a spike support member having a channel, a spike plate secured at least partially within the channel and movable between the flat position and the banking position, and a spike configured to engage a running surface is positioned at each end of the spike plate. Preferably, at least one spike is also positioned on the spike plate between the spikes at each end of the spike plate.

BRIEF DESCRIPTION OF THE DRAWINGS

The figures depict embodiments for purposes of illustration only. One skilled in the art will readily recognize from the following description that alternative embodiments of the structures and methods illustrated herein may be employed without departing from the principles described herein, wherein.

DETAILED DESCRIPTION

The present disclosure describes track-and-field athletic shoes ("track shoes") and sole structures for such track shoes. In the embodiments of the present disclosure, the sole structures may include one or more spike assemblies with movable spikes that enhance the grip of the track shoe over an entire course of a track, including when banking on a turn.

Figure 1:
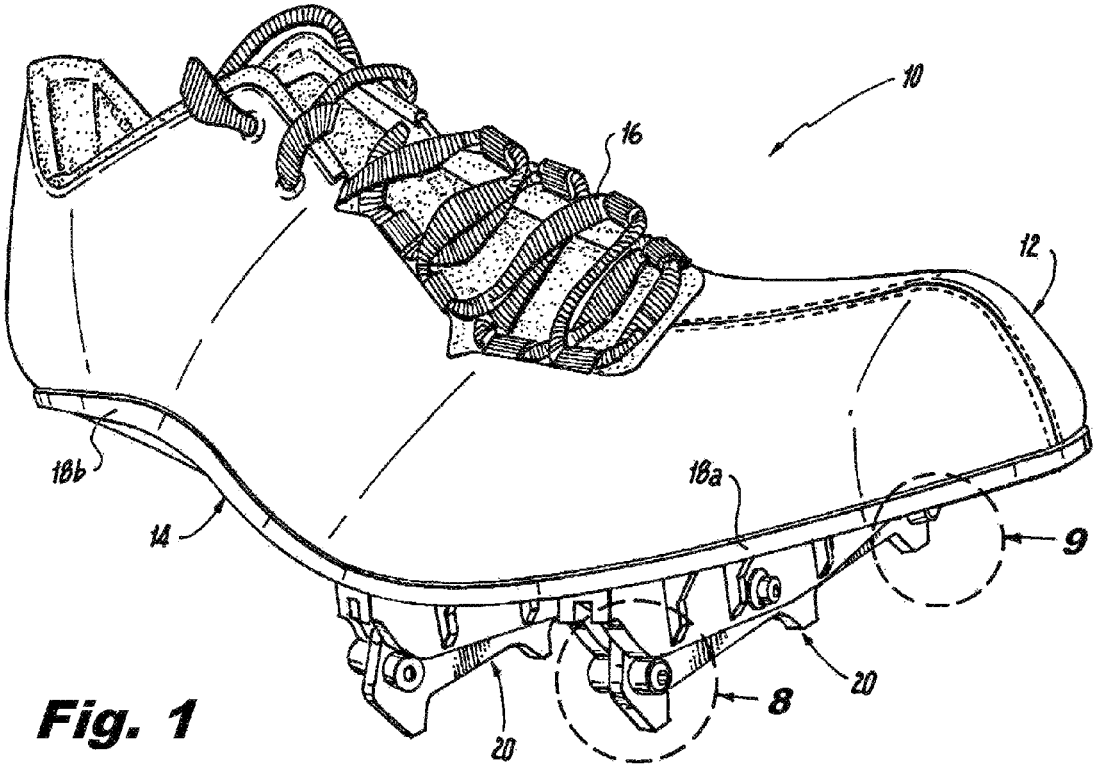
FIG. 1 is an perspective view of an exemplary embodiment of a track shoe according to the present disclosure.
Figure 3:
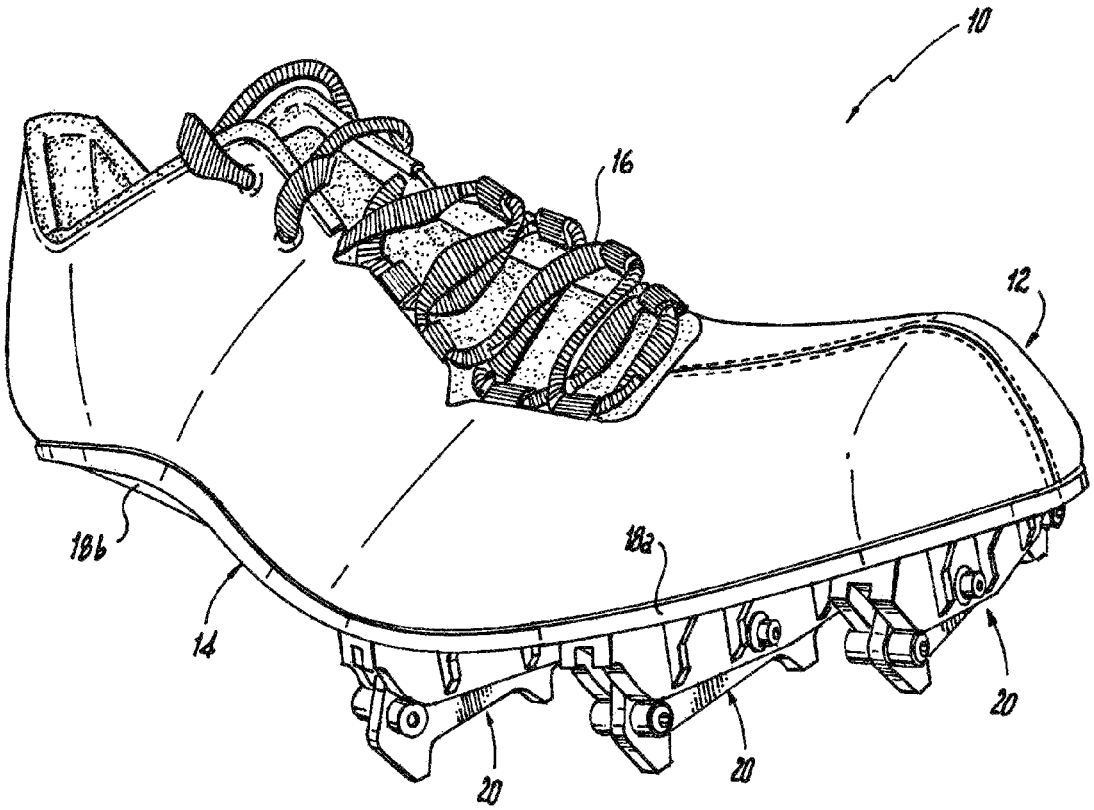
FIG. 3 is an perspective view of another exemplary embodiment of a track shoe according to the present disclosure.

Referring to FIGS. 1 and 3, the track shoe 10 has an upper 12 and a sole 14. The upper 12 can be formed as any conventional upper configured to support the foot of a runner, in particular an upper adapted for use in a track shoe. The upper 12 includes lace holes or eyelets along the throat of the upper to accommodate laces 16. Typically, the upper has several layers, including a weather-resistant and wear-resistant outer layer of leather or synthetic material, such as nylon, and a soft, padded inner liner for foot comfort. Current uppers typically have an intermediate layer of a synthetic foam material. The layers of the upper 12 may be fastened together by stitching, gluing, or a combination thereof.

The sole 14 is formed of a plate 18 which extends along substantially the entire length of the track shoe 10. The sole 14 and plate 18 can be broadly divided into a forefront region 18*a* and a rearward region 18*b*. Generally, the forefront region 18*a* includes the area of track shoe 10 beneath the toe and the ball of the foot of a wearer, and the rearward region 18*b* includes the portion of the track shoe below the arch and heel of a wearer. The plate 18 is preferably formed of a relatively hard, light weight material, such as polyamide or a polyurethane plastic. An example of a suitable polyamide is nylon 12, and an example of a suitable polyurethane plastic is thermoplastic polyurethane (TPU). The rearward region 18*b* of the plate 18 is preferably thinner than the forefront region 18*a*. For example, the rearward region 18*b* of plate 18 can have a thickness of approximately 2 mm, and the forefront region 18*a* of plate 18 can have a thickness of approximately 2.5 mm. The plate 18 may be fastened to the bottom of the upper 12 by stitching, gluing, or a combination thereof. The bottom of the rearward region 18*b* of the plate 18 may include a rubber layer (not shown) for added traction, as is known in the art. A midsole formed of a resilient shock absorbing material may be included in sole 14 along the heel and arch area of the track shoe. A midsole, if included, would be relatively thin to minimize weight.

Continuing to refer to FIGS. 1 and 3, the forefront region 18*a* of the plate 18 includes one or more spike assemblies 20. The spike assemblies may be molded into the plate 18 or secured to the plate 18 using, for example, glue, epoxy or rivets. When more than one spike assembly are used, it is preferred that the spike assemblies are spaced far enough apart to allow the track shoe 10 to flex while running. For example, in the embodiments shown, the spike assemblies are spaced apart a distance of about 35 mm.

Figure 2:
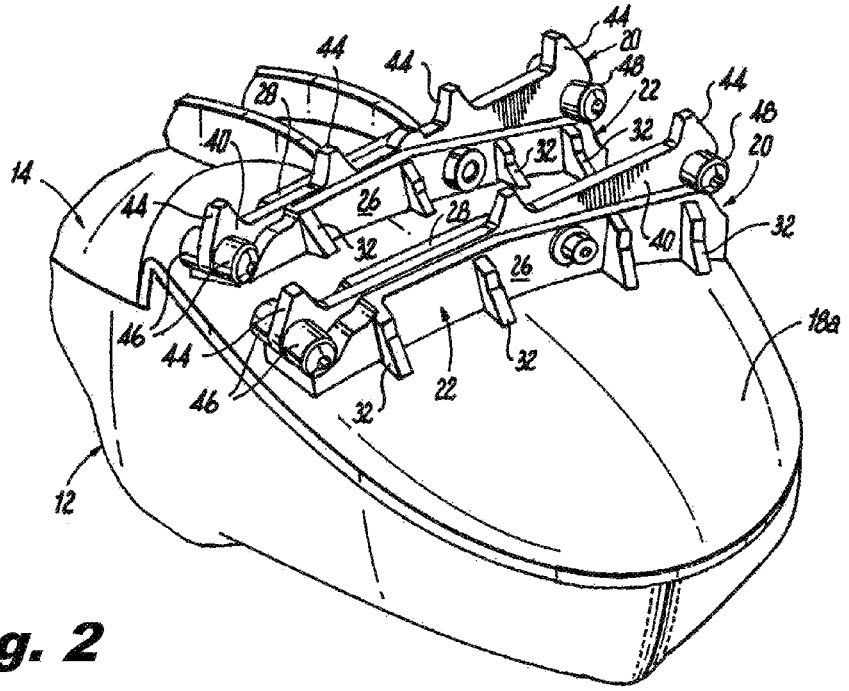
FIG. 2 is a perspective view of a forefront portion of a sole of the track shoe of FIG. 1, illustrating an exemplary embodiment of track spikes according to the present disclosure.
Figure 11:
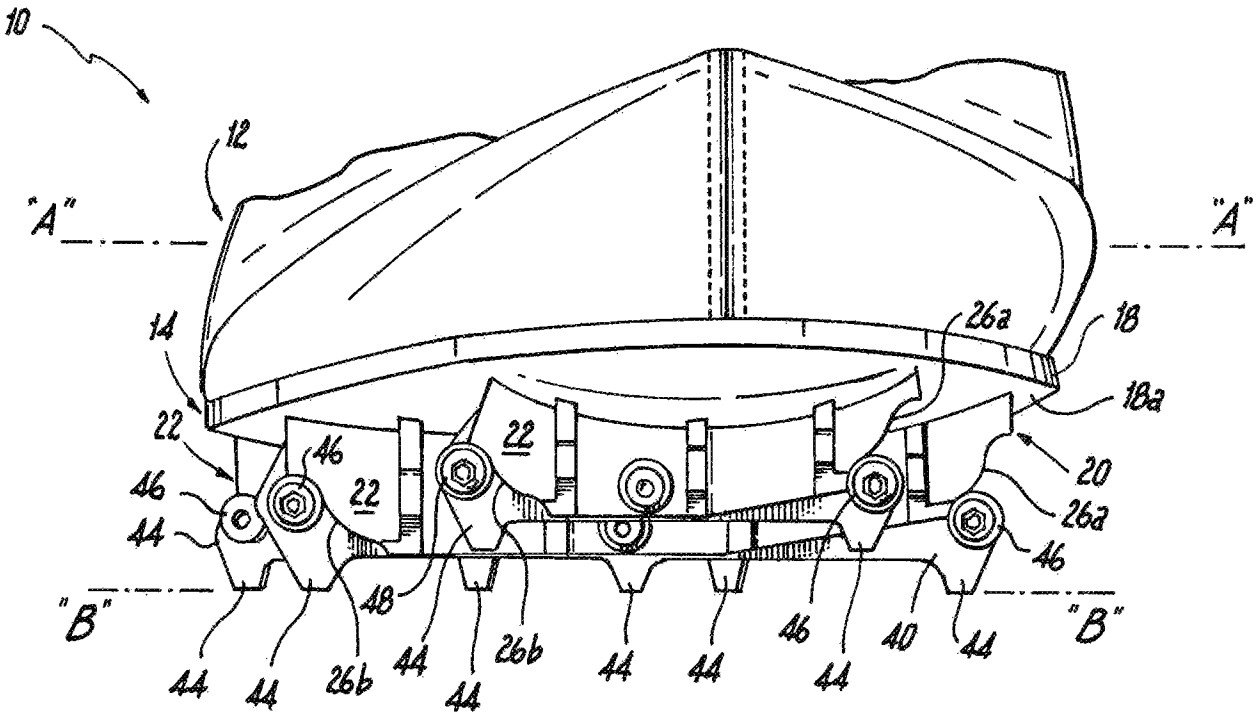
FIG. 11 is an a front elevation view of the track shoe shown at arrow 11 of FIG. 10, illustrating a position of the shoe while running on a flat surface of a track and a related position of the spikes.
Figure 12:
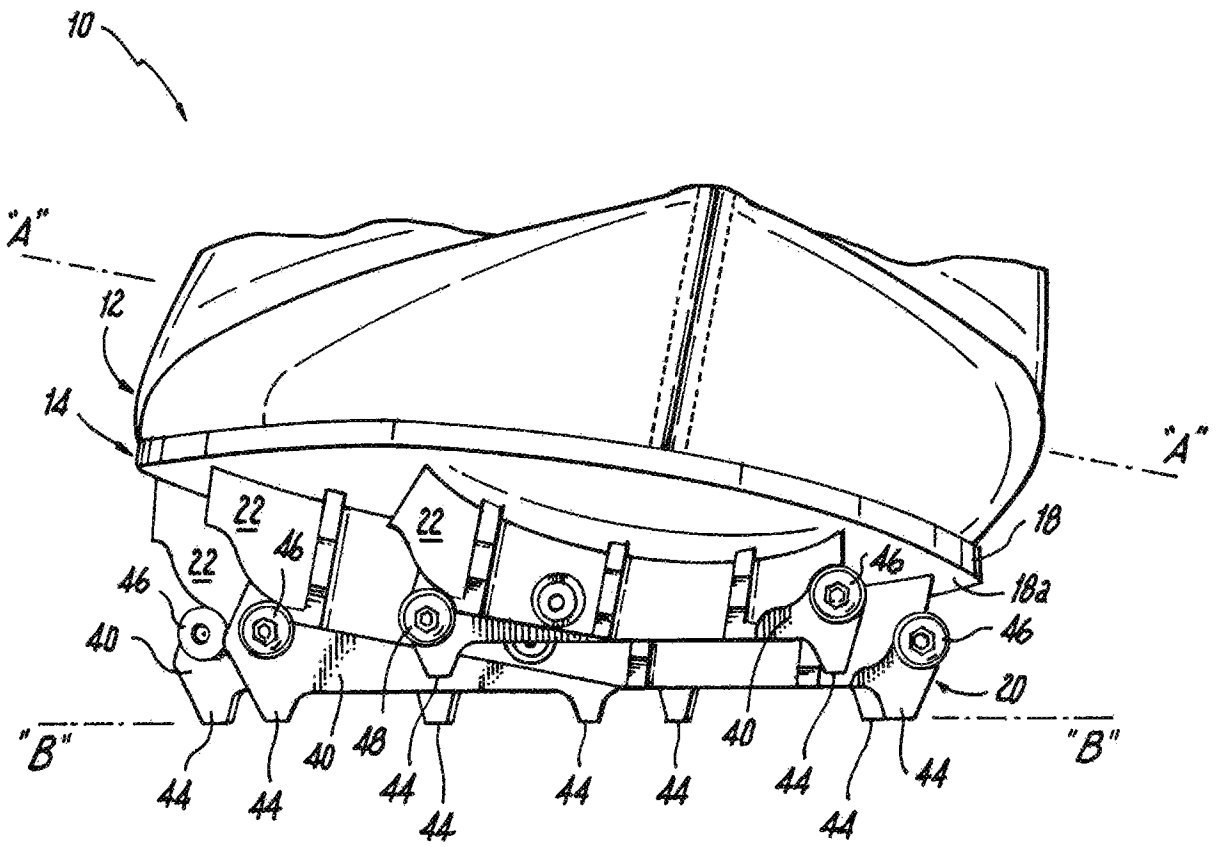
FIG. 12 is a front elevation view similar to FIG. 11, illustrating a position of the shoe while banking on a track and a related position of the spikes.

In the exemplary embodiment of FIGS. 1 and 2, the track shoe includes two spike assemblies 20 spaced apart in the forefront region 18*a* of the plate 18, as shown. In the exemplary embodiment of FIGS. 3 and 4, the track shoe includes three spike assemblies 20 spaced apart in the forefront region 18*a* of the plate 18, as shown. The spike assemblies 20 are configured to move the spike plate and spikes between a flat position where the surface engaging area of the spikes, represented by Axis "B", are substantially parallel to Axis "A" of the track shoe 10 (as seen in FIG. 11), and a banking position where the surface engaging area of the spikes, represented by Axis "B", are at an angle relative to Axis "A" of the track shoe 10 (as seen in FIG. 12). The angle relative to Axis "A" is in the range of between about 5 degrees and about 15 degrees, and preferably the angle is 10 degrees. It should be noted that the spike assemblies according to the present disclosure are preferably constructed similar to a four-bar linkage system, except the links are replaced with cams. In the four-bar linkage system employed in the spike assemblies of the present disclosure, the spikes move in parallel planes relative to a running surface and the sole of the track shoe so that the spikes are positioned for peak traction while running on a flat surface or when banking.

Figure 5:
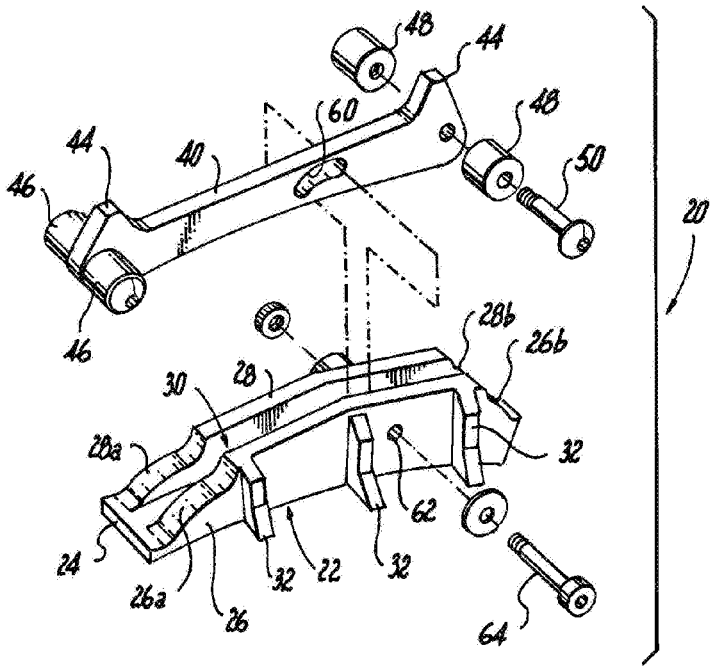
FIG. 5 is an exploded view of an exemplary embodiment of a track spike assembly according to the present disclosure.
Figure 6:
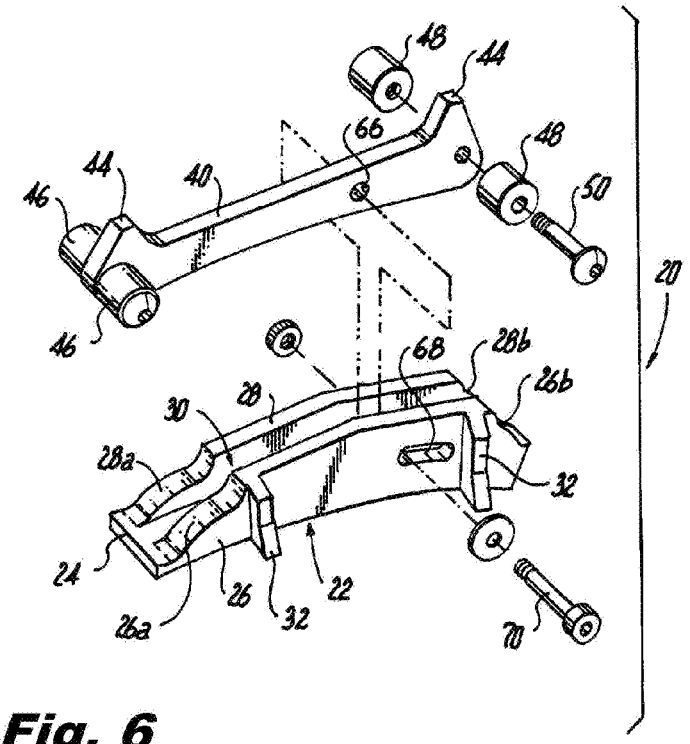
FIG. 6 is an exploded view of another exemplary embodiment of a track spike assembly according to the present disclosure.
Figure 7:
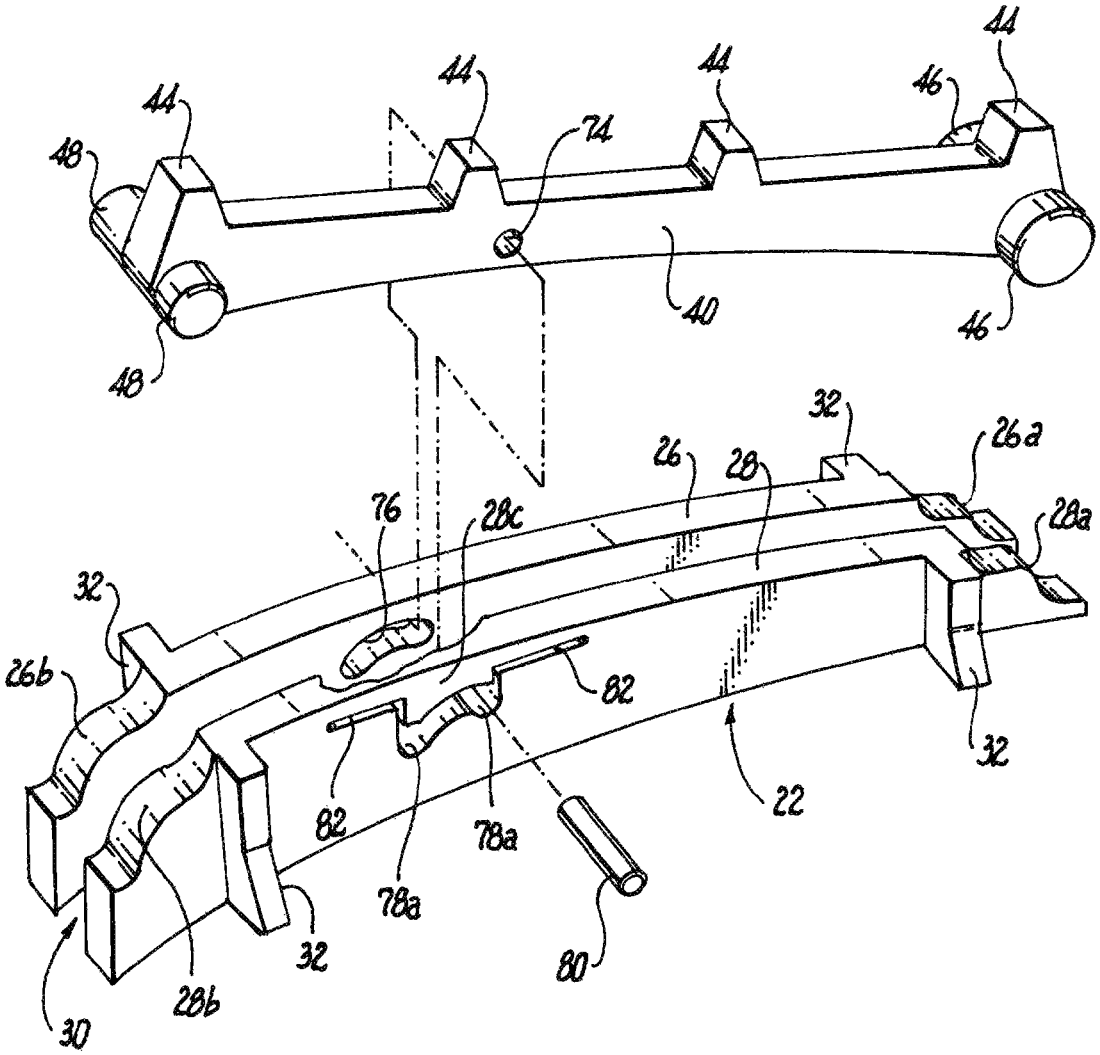
FIG. 7 is an exploded view of another exemplary embodiment of a track spike assembly according to the present disclosure.

Referring to FIGS. 5-7, exemplary embodiments of spike assemblies are shown. The spike assembly 20 includes a spike support member 22 that can either be molded into or secured to the sole 14. The spike support member 22 is preferably formed of a relatively hard, light weight material, such as polyamide or a polyurethane plastic. An example of a suitable polyamide is nylon 12, and an example of a suitable rigid polyurethane plastic is thermoplastic polyurethane (TPU). Alternatively, the spike support member can be made of metal or metal alloy, preferably a lightweight metal or metal alloy, such as titanium or aluminum, or the spike support member can be made of any other suitable material sufficient to support the movable spikes and weight of a person wearing the track shoe 10. Preferably, the spike support member 22 has a base 24 and side walls 26 and 28 extending from the base such that the base and side walls form a channel 30. The base 24 and walls 26 and 28 are preferably formed of a relatively hard, light weight material, such as polyamide or a rigid polyurethane plastic. An example of a suitable polyamide is nylon 12, and an example of a suitable rigid polyurethane plastic is thermoplastic polyurethane (TPU). Alternatively, the base 24, and walls 26 and 28 can be made of metal or metal alloy, preferably a lightweight metal or metal alloy, such as titanium or aluminum, or the base 24, and walls 26 and 28 can be made of any other suitable material sufficient to support the movable spikes and weight of a person wearing the track shoe 10.

If the spike support member 22 is molded into the plate 18, the base 24 will follow the contours of the plate 18 based upon the molding process implemented. If the spike support member 22 is secured to the plate 18, the base 24 would preferably be configured to conform to the contours of the plate 18 so that there is an even seem between the plate 18 and the spike support member 22.

Figure 4:
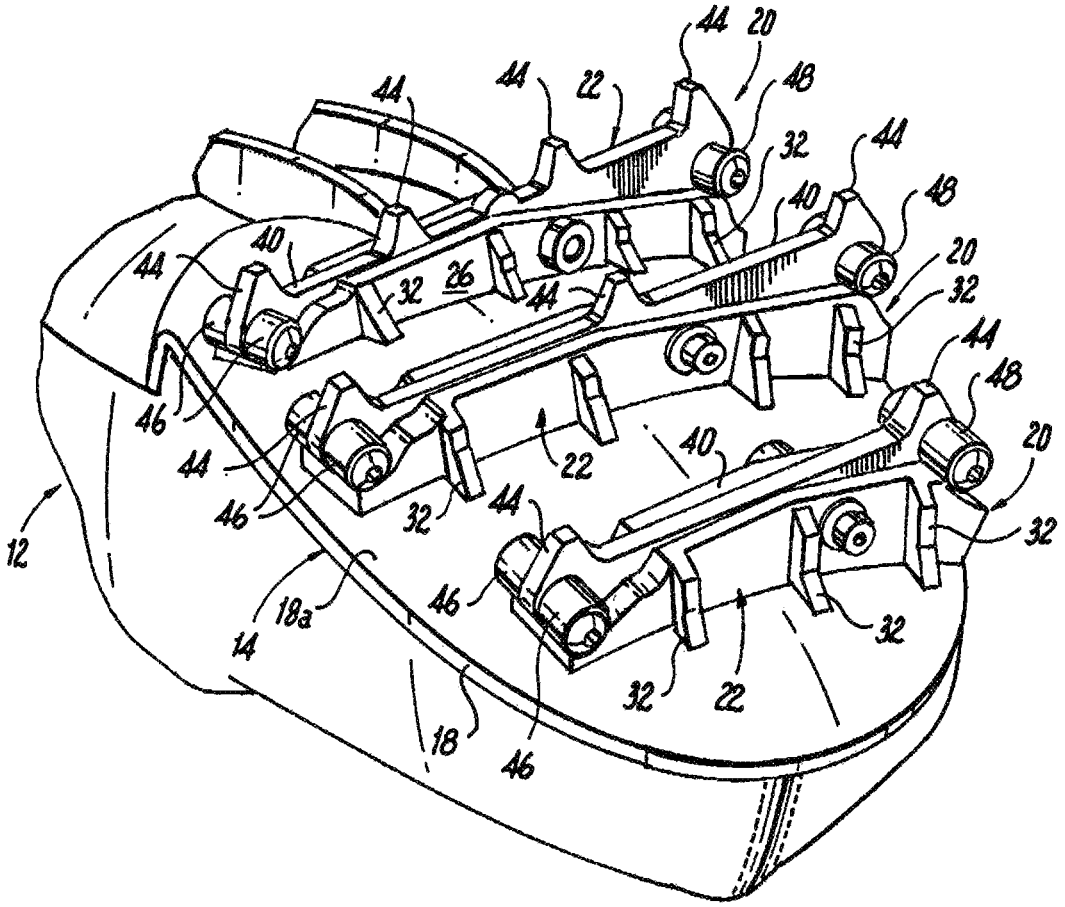
FIG. 4 is a perspective view of a forefront portion of a sole of the track shoe of FIG. 3, illustrating another exemplary embodiment of track spikes according to the present disclosure.

The walls 26 and 28 are preferably reinforced with gussets 32 positioned along each side wall, as shown. The gussets 32 can be molded into, or secured to the side walls 26 or 28 and the plate 18. The gussets 32 are preferably formed of a relatively hard, light weight material, such as polyamide or a polyurethane plastic. An example of a suitable polyamide is nylon 12, and an example of a suitable rigid polyurethane plastic is thermoplastic polyurethane (TPU). Alternatively, the gussets 32 can be made of metal or metal alloy, preferably a lightweight metal or metal alloy, such as titanium or aluminum, or the gussets 32 can be made of any other suitable material sufficient to reinforce and support the walls 26 and 28. The number of gussets 32 positioned along each side wall depends upon the length of the side wall and the number of spikes on the spike plate. In the embodiment of FIGS. 1 and 2, the long spike assemblies 20 have four gussets positioned along each side wall 26 and 28. In the embodiment of FIGS. 3 and 4, the short spike assembly 20 closest to the toe has three gussets 32 positioned along each side wall 26 and 28, and the long spike assemblies 20 have four gussets 32 positioned along each side wall 26 and 28. The gussets 32 may be positioned along the wall in close proximity to where a spike would be to provide reinforcement in the area where the spikes are located.

Positioned within channel 30 of spike support member 22 is a spike plate 40. The spike plate 40 is preferably formed of a relatively hard, light weight material, such as polyamide or a polyurethane plastic. An example of a suitable polyamide is glass filled nylon 12, and an example of a suitable polyurethane plastic is glass filled thermoplastic polyurethane (TPU). Alternatively, the spike plate can be made of metal or metal alloy, preferably a lightweight metal or metal alloy, such as titanium or aluminum, or the spike plate can be made of any other suitable material sufficient to support the movable spikes and weight of a person wearing the track shoe 10. Spike plate 40 includes one or more spikes 44 positioned on the spike plate and extending away from the sole 14. The spikes 44 are configured to engage a running surface, such as a track, and can be flat, rectangular structures as shown, or the spikes may be conical structures, or the spikes may be any other conventional spike structure. Preferably, each end of the spike plate 40 has a spike 44, and one or more spikes 44 may be positioned on the spike plate 40 between the end spikes. The number and positioning of spikes 44 between the end spikes is a matter design choice. FIG. 4 shows spike plates 40 having two, three and four spikes 44. The spikes 44 are preferably formed of a relatively hard, light weight material, such as polyamide or a polyurethane plastic. An example of a suitable polyamide is nylon 12, and an example of a suitable polyurethane plastic is thermoplastic polyurethane (TPU). Alternatively, the spikes can be made of metal or metal alloy, preferably a lightweight metal or metal alloy, such as titanium or aluminum, or the spikes can be made of any other suitable material sufficient to grip the running surface and support the weight of a person wearing the track shoe 10.

Figure 8:
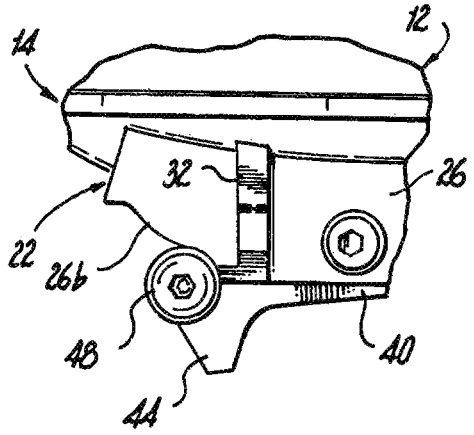
FIG. 8 is an elevation view taken from arrow 8 of FIG. 1, illustrating one end spike in a banking position.
Figure 9:
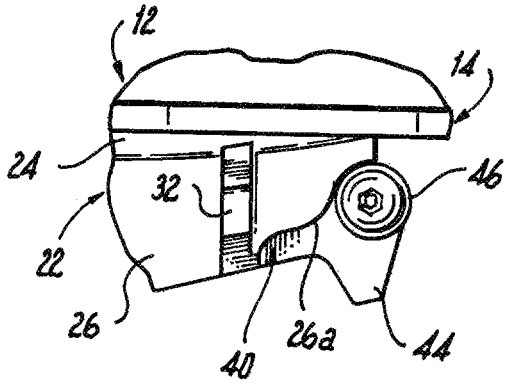
FIG. 9 is an elevation view taken from arrow 9 of FIG. 1, illustrating the other end spike in the banking position.

Cam members 46 and 48 are secured to each end of the spike plate 40 using known fastening techniques. For example, the cam members 48 may be secured to each spike plate 40 by passing screw 50 through one cam member 48 and the spike plate 40 into threaded cam member 48, as shown. Alternatively, nuts and bolts, rivets, glues, epoxies, or other fasteners may be used to secure the cam members 46 and 48 to the spike plate 40. Alternatively, the cam members may be molded directly into the spike plate 40 or otherwise formed as part of the spike plate. The cam members 46 and 48 are preferably formed of a relatively hard, light weight material, such as polyamide or a polyurethane plastic. An example of a suitable polyamide is nylon 12, and an example of a suitable polyurethane plastic is thermoplastic polyurethane (TPU). Alternatively, the cam members can be made of metal or metal alloy, preferably a lightweight metal or metal alloy, such as titanium or aluminum, or the cam members can be made of any other suitable material sufficient to support the movable spikes and weight of a person wearing the track shoe 10. As seen in FIGS. 8 and 9, cam members 46 are configured to ride along cam surfaces 26*a* and 28*a* of walls 26 and 28, respectively, when the spike plate 40 and spikes 44 are moved between the flat position and the banking position. Cam members 48 are configured to ride along cam surfaces 26*b* and 28*b* of walls 26 and 28, respectively, when the spike plate 40 and spikes 44 are moved between the flat position and the banking position.

As noted, the spike plate 40 is movably secured to the spike support member 22 within the channel 30. A linkage assembly is used to facilitate movement of the spike plate 40 and the spikes 44. In one embodiment shown in FIG. 5, the linkage assembly includes guide opening or j-shaped slot 60 in spike plate 40, mounting aperture 62 in each side wall 26 and 28, and guide member 64, such as a nut and bolt, or pin, that can pass through the side walls and rest within the guide opening 60. In this linkage assembly, the guide member 64 performs a number of functions. First, the guide member 64 acts as a fastener to movably secure the spike plate 40 to the spike support member 22. Second, the guide member 64 acts as a guide link controlling movement of the spike plate 40 (and thus the spikes 44) between the flat position and the banking position. Third, the guide member 64, working with guide opening 60, acts as a stop to limit the movement of the spike plate 40. The guide member 64 acts as a focal point for movement of the spike plate 40 between the flat position and the banking position.

In another embodiment shown in FIG. 6, the linkage assembly includes mounting aperture 66 in spike plate 40, guide openings or slots 68 in side walls 26 and 28, and guide member 70, such as a nut and bolt, or pin, that can pass through the guide openings 68 in the side walls and rests within the mounting aperture 66 in the spike plate 40. Similar to the embodiment of FIG. 5, in this configuration, the guide member 70 performs a number of functions. First, the guide member 70 acts as a fastener to movably secure the spike plate 40 to the spike support member 22. Second, the guide member 70 acts as a guide link guiding the spike plate between the flat position and the banking position. Third, the guide member 70, working with the guide openings 68, acts as a stop to limit the movement of the spike plate 40. The guide member 70 acts as a focal point for movement of the spike plate 40 between the flat position and the banking position.

In another embodiment shown in FIG. 7, the linkage assembly includes mounting aperture 74 in spike plate 40, j-shaped slots 76 and 78 in side walls 26 and 28, respectively, and guide member 80, such as a pin, that can pass through the j-shaped slot 76 in side wall 26, through the mounting hole 74 in the spike plate 40, and through j-shaped slot 78 in side wall 28. Preferably, each end of j-shaped slot 78 has a detent 78*a* configured to receive the guide member 80. In this embodiment, the mounting aperture 74 is smaller than the diameter of the guide member 80 so that guide member can be pressed into position within the mounting aperture 74 and the friction between the aperture 74 and the guide member 80 maintains the pin in position. The j-shaped slot 76 is about the size of the diameter of the guide member 80 so that the guide member can freely glide within the j-shaped slot 76. The j-shaped slot 78 is preferably smaller than the size of the diameter of the guide member 80 so that the guide member cannot freely glide within the j-shaped slot 78. As such, a force would be needed to move the guide member 80 within the j-shaped slot 78, as will be described in more detail below. The j-shaped slot 78 has a pair of channels 82 extending along the wall 28, as shown. The channels 82 provide flexibility to an area 28*c* of wall 28 to allow the guide member to move within the j-shaped slot 78, as will be described in more detail below.

In the embodiments of FIGS. 5 and 6, the cam surfaces 26*a* and 26*b*, the cam surfaces 28*a* and 28*b*, and the cam members 46 and 48 are configured such that when a force is applied to the linkage assembly, the spike plate 40 and spikes 44 can move from one position, e.g., the flat position, to the other position, e.g., the banking position, and the spike plate 40 is releasably locked into each position. In the embodiment of FIG. 7, the linkage assembly along with the cam surfaces, and cam members releasably lock the spike plate 40 and spikes 44 in either the flat position or the banking position.

Figure 10:
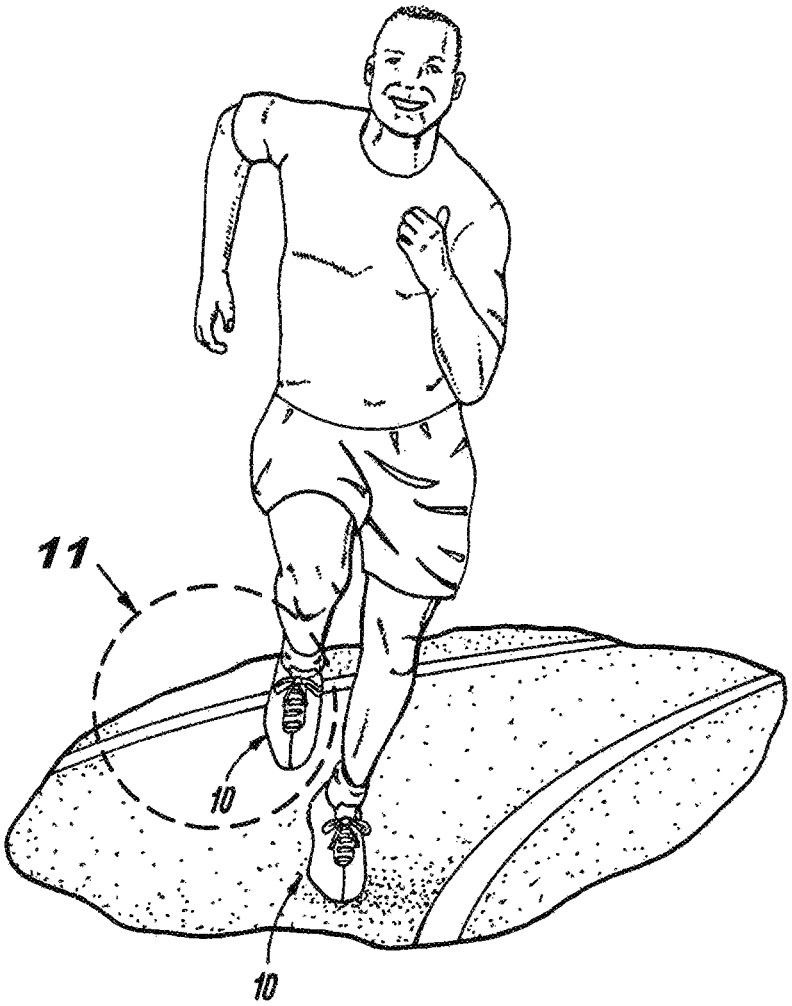
FIG. 10 is a perspective view of an athlete running along the bank of a track.

Turing to FIGS. 10-12, when a runner is banking on a turn of a track, seen in FIG. 10, the weight and angle of the runner relative to the running surface, here a track, applies lateral force to the linkage assembly. When the lateral force applied exceeds a predetermined number, the linkage assembly activates so that the spike plate 40 automatically moves from the flat position (shown in FIG. 11) to the banking position (shown in FIG. 12). When the runner returns to a non-banking part of the running surface, the position of the runner again shifts so that the weight and angle of the runner applies a vertical force to the linkage assembly. When the vertical force applied exceeds a predetermined number, the linkage assembly again activates so that the spike plate 40 automatically moves from the banking position to the flat position. The force needed to activate the linkage assembly and move the spike plate is in the range of about 3 lbs and about 8 lbs. As an example and referring to the spike assembly embodiment of FIG. 7, when a lateral force caused by a runner is applied to the spike assembly 20, that force would be applied to the linkage assembly. When the lateral force applied exceeds for example, 3 lbs, there is sufficient force to cause the area 28*c* in wall 28 to flex allowing the guide member 80 to move from one position, e.g., the flat position, to the other position, e.g., the banking position.

While the present disclosure describes various embodiments of a track shoe and various embodiments of sole structures and spike assemblies for track shoes, it will be understood that various modifications can be made to the embodiments of the present disclosure herein without departing from the spirit and scope thereof. Therefore, the above description should not be construed as limiting the disclosure, but merely as embodiments thereof. Those skilled in the art will envision other modifications within the scope and spirit of the invention as defined by the claims appended hereto.

What is claimed is:

1. A track shoe, comprising:

an upper; and a sole secured to the upper, the sole having at least one track spike assembly positioned at a forefront region of the sole;

wherein the at least one track spike assembly comprises:

a spike support member that includes a first wall, a second wall, a channel between the first wall and the second wall, at least one gusset supporting the first wall and at least one gusset supporting the second wall, wherein the first wall has a first camming surface profile at one end and a second camming surface profile at a second end, the second wall has a third camming surface profile at one end and a fourth camming surface profile at a second end; and a spike plate having at least one first cam member at a first end and at least one second cam member at a second end, wherein the at least one first cam member is aligned with the first camming surface profile and the third camming surface profile and the at least one second cam member is aligned with the second camming surface profile and the fourth camming surface profile, the spike plate being positioned at least partially within the channel and coupled to the spike support member walls such that the at least one first cam member can move along the first and third camming surface profiles and the at least one second cam member can move along the second and fourth camming surface profiles as the spike plate moves between a flat position and a banking position; and a first spike configured to engage a running surface positioned at the first end of the spike plate and a second spike configured to engage the running surface positioned at the second end of the spike plate.

2. The track shoe according to claim 1, further comprising at least one additional spike positioned on the spike plate between the first spike and the second spike.

3. The track shoe according to claim 1, wherein the at least one track spike assembly comprises a plurality of track spike assemblies.

4. The track shoe according to claim 1, wherein the spike plate is coupled to the spike support member with a linkage assembly.

5. The track shoe according to claim 4, wherein the linkage assembly holds the spike plate in the flat position or the banking position until a predetermined force is applied to the spike plate.

6. A sole for a track shoe, comprising:

a plate having a forefront region and a rearward region;

at least one track spike assembly positioned at the forefront region of the plate, wherein the at least one track spike assembly comprises:

a spike support member that includes a first wall, a second wall, a channel between the first wall and the second wall, at least one gusset supporting the first wall and at least one gusset supporting the second wall, wherein the first wall has a first camming surface profile at one end and a second camming surface profile at a second end, the second wall has a third camming surface profile at one end and a fourth camming surface profile at a second end; and a spike plate having at least one first cam member at a first end and at least one second cam member at a second end, wherein the at least one first cam member is aligned with the first camming surface profile and the third camming surface profile and the at least one second cam member is aligned with the second camming surface profile and the fourth camming surface profile, the spike plate being positioned at least partially within the channel and coupled to the spike support member walls such that the at least one first cam member can move along the first and third camming surface profiles and the at least one second cam member can move along the second and fourth camming surface profiles as the spike plate moves between a flat position and a banking position; and a first spike configured to engage a running surface positioned at the first end of the spike plate and a second spike configured to engage the running surface positioned at the second end of the spike plate.

7. The sole for a track shoe according to claim 6, further comprising at least one additional spike positioned on the spike plate between the first spike and the second spike.

8. The sole for a track shoe according to claim 6, wherein the at least one track spike assembly comprises a plurality of track spike assemblies.

9. The sole for a track shoe according to claim 6, wherein the spike plate is coupled to the spike support member with a linkage assembly.

10. The sole for a track shoe according to claim 9, wherein the linkage assembly holds the spike plate in the flat position or the banking position until a predetermined force is applied to the spike plate.

11. A track shoe, comprising:

an upper;

a sole secured to the upper; and at least one track spike assembly positioned at a forefront region of the sole, the at least one track spike assembly comprising:

a spike support member having a first camming surface profile at one end, a second camming surface profile at a second end, a channel, and a plurality of gussets supporting the spike support member; and a spike plate having at least one first cam member at a first end and at least one second cam member at a second end, the spike plate being positioned at least partially within the channel;

a partially movable linkage assembly coupling the spike plate to the spike support member such that the at least one first cam member can slide along the first camming surface and the at least one second cam member can slide along the second camming surface as the spike plate moves between a flat position and a banking position; and a first spike configured to engage a running surface positioned at the first end of the spike plate and a second spike configured to engage the running surface positioned at the second end of the spike plate.

12. The track shoe according to claim 11, wherein the linkage assembly holds the spike plate in the flat position or the banking position until a predetermined force is applied to the spike plate.

13. The track shoe according to claim 11, wherein the linkage assembly comprises:

an aperture in the support member;

an elongated slot in the spike plate aligned with the aperture; and a guide member that passes through the aperture and elongated slot;

wherein the guide member moves within the elongated slot as the spike plate moves between the flat position and the banking position, and wherein the elongated slot is configured to hold the guide member in the flat position or the banking position.

14. The track shoe according to claim 13, wherein the guide member comprises a pin.

15. The track shoe according to claim 11, wherein the linkage assembly comprises:

at least one elongated slot in the support member;

an aperture in the spike plate aligned with the at least one slot; and a guide member that passes through the slot and aperture;

wherein the guide member moves within the elongated slot as the spike plate moves between the flat position and the banking position, and wherein the elongated slot is configured to hold the guide member in the flat position or the banking position.

16. The track shoe according to claim 15, wherein the guide member comprises a pin.

17. A track shoe, comprising:

an upper; and a sole secured to the upper, the sole having at least one track spike assembly positioned at a forefront region of the sole;

wherein the at least one track spike assembly comprises:

a spike support member having a first camming surface profile at one end, and a second camming surface profile at a second end, a channel and a plurality of gussets supporting the spike support member; and a spike plate having at least one first cam member at a first end and at least one second cam member at a second end, the spike plate being positioned at least partially within the channel and coupled to the spike support member such that the at least one first cam member can move along the first camming surface profile and the at least one second cam member can move along the second camming surface profile as the spike plate moves between a flat position and a banking position; and a first spike configured to engage a running surface positioned at the first end of the spike plate and a second spike configured to engage the running surface positioned at the second end of the spike plate.

18. The track shoe according to claim 17, further comprising at least one additional spike positioned on the spike plate between the first spike and the second spike.

19. The track shoe according to claim 17, wherein the at least one track spike assembly comprises a plurality of track spike assemblies.

20. The track shoe according to claim 17, wherein the spike plate is coupled to the spike support member with a linkage assembly.

21. The track shoe according to claim 20, wherein the linkage assembly holds the spike plate in the flat position or the banking position until a predetermined force is applied to the spike plate.

22. A sole for a track shoe, comprising:

a plate having a forefront region and a rearward region;

at least one track spike assembly positioned at the forefront region of the plate, wherein the at least one track spike assembly comprises:

a spike support member having a first camming surface profile at one end, and a second camming surface profile at a second end, a channel, and a plurality of gussets supporting the spike support member; and a spike plate having at least one first cam member at a first end and at least one second cam member at a second end, the spike plate being positioned at least partially within the channel and coupled to the spike support member such that the at least one first cam member can move along the first camming surface profile and the at least one second cam member can move along the second camming surface profile as the spike plate moves between a flat position and a banking position; and a first spike configured to engage a running surface positioned at the first end of the spike plate and a second spike configured to engage the running surface positioned at the second end of the spike plate.

23. The sole for a track shoe according to claim 22, further comprising at least one additional spike positioned on the spike plate between the first spike and the second spike.

24. The sole for a track shoe according to claim 22, wherein the at least one track spike assembly comprises a plurality of track spike assemblies.

25. The sole for a track shoe according to claim 22, wherein the spike plate is coupled to the spike support member with a linkage assembly.

26. The sole for a track shoe according to claim 25, wherein the linkage assembly holds the spike plate in the flat position or the banking position until a predetermined force is applied to the spike plate.

27. A track shoe, comprising:

an upper;

a sole secured to the upper; and at least one track spike assembly positioned at a forefront region of the sole, the at least one track spike assembly comprising:

a spike support member having a first camming surface profile at one end, a second camming surface profile at a second end, a channel, and a plurality of gussets supporting the spike support member; and a spike plate having at least one first cam member at a first end and at least one second cam member at a second end, the spike plate being positioned at least partially within the channel;

a linkage assembly coupling the spike plate to the spike support member such that the at least one first cam member can slide along the first camming surface profile and the at least one second cam member can slide along the second camming surface profile as the spike plate moves between a flat position and a banking position; and a first spike configured to engage a running surface positioned at the first end of the spike plate and a second spike configured to engage the running surface positioned at the second end of the spike plate.

28. The track shoe according to claim 27, wherein the linkage assembly holds the spike plate in the flat position or the banking position until a predetermined force is applied to the spike plate.

29. The track shoe according to claim 27, wherein the linkage assembly comprises:

an aperture in the support member;

an elongated slot in the spike plate aligned with the aperture; and a guide member that passes through the aperture and elongated slot;

wherein the guide member moves within the elongated slot as the spike plate moves between the flat position and the banking position, and wherein the elongated slot is configured to hold the guide member in the flat position or the banking position.

30. The track shoe according to claim 29, wherein the guide member comprises a pin.

31. The track shoe according to claim 27, wherein the linkage assembly comprises:

at least one elongated slot in the support member;

an aperture in the spike plate aligned with the at least one slot; and a guide member that passes through the slot and aperture;

wherein the guide member moves within the elongated slot as the spike plate moves between the flat position and the banking position, and wherein the elongated slot is configured to hold the guide member in the flat position or the banking position.

32. The track shoe according to claim 31, wherein the guide member comprises a pin.

* * * * *